United States Patent [19]

Kudo et al.

[11] Patent Number: 4,668,310

[45] Date of Patent: May 26, 1987

[54] AMORPHOUS ALLOYS

[75] Inventors: Mitsuhiro Kudo; Shinji Takayama, both of Tokyo; Yoshizo Sawada; Yasunobu Ogata, both of Saitama, all of Japan

[73] Assignees: Hitachi Metals, Ltd.; Hitachi, Ltd., both of Tokyo, Japan

[21] Appl. No.: 474,886

[22] Filed: Mar. 14, 1983

Related U.S. Application Data

[63] Continuation of Ser. No. 269,004, filed as PCT JP80/00212 on Sep. 22, 1980, published as WO81/00861 on April 2, 1981, abandoned.

[30] Foreign Application Priority Data

Sep. 22, 1980 [PC] 09221980 ..... PCT/JP80/00212
Sep. 21, 1979 [JP] Japan ..... 54-121661
Sep. 21, 1979 [JP] Japan ..... 54-121663

[51] Int. Cl.[4] ..... H01F 1/04

[52] U.S. Cl. ..... 148/304; 148/403; 420/9; 420/36; 420/75; 420/77; 420/78; 420/83; 420/86; 420/99; 420/103; 420/117; 420/118; 420/119; 420/121; 420/122; 420/125; 420/126; 420/127; 420/435; 420/436; 420/442; 420/581; 420/583

[58] Field of Search ..... 148/403, 31.55, 442; 75/123 B, 123 E, 123 J, 123 L, 123 K, 123 H, 124 B, 124 C, 124 E, 124 F, 125, 126 F, 126 H; 420/435, 436, 442, 581, 583, 304

[56] References Cited

U.S. PATENT DOCUMENTS

| | | | |
|---|---|---|---|
| 3,940,293 | 2/1976 | Polk et al. | 75/170 |
| 3,986,867 | 10/1976 | Matsumoto et al. | 75/126 A |
| 4,036,638 | 7/1977 | Ray | 75/170 |
| 4,038,073 | 7/1977 | O'Handley et al. | 148/31.55 |
| 4,053,333 | 10/1977 | Egami et al. | 75/170 |
| 4,056,411 | 11/1977 | Chen et al. | 75/170 |
| 4,067,732 | 1/1978 | Ray | 75/170 |
| 4,116,682 | 9/1978 | Polk et al. | 75/170 |
| 4,144,058 | 3/1979 | Chen et al. | 75/170 |
| 4,150,981 | 4/1979 | O'Handley | 75/170 |
| 4,188,211 | 2/1980 | Yamaguchi et al. | 75/170 |
| 4,225,339 | 9/1980 | Inomata et al. | 148/31.55 |
| 4,249,969 | 2/1981 | DeCristofaro et al. | 148/31.57 |
| 4,255,189 | 3/1981 | Ray | 75/170 |
| 4,259,109 | 3/1981 | Hasegawa | 75/123 B |
| 4,306,908 | 12/1981 | Takayama et al. | 75/170 |
| 4,325,733 | 4/1982 | Aboaf et al. | 75/123 K |
| 4,365,994 | 12/1982 | Ray | 148/403 |

FOREIGN PATENT DOCUMENTS

| | | |
|---|---|---|
| 51-4017 | 1/1976 | Japan . |
| 51-73920 | 6/1976 | Japan . |
| 55-138049 | 10/1980 | Japan . |

OTHER PUBLICATIONS

Buxhow et al, "Thermal Stability and Electronic Properties of Amorphous Zr-Co and Zr-Ni Alloys", Phy. Rev. B, vol. 19, #8, Apr. 15, 1979, pp. 3843-3849.

Heiman et al, "Magnetic Properties of Amorphous Alloys of Fe with La, Lu, Y and Zr", Phy. Rev. B, vol. 19, No. 3, Feb. 1, 1979, pp.

Heiman et al, "Concentration Dependence of the Co Moment in Amorphous Alloys of Co with Y, La and Zr", Phy. Rev. B, vol. 17, No. 5, Mar. 1, 1978, pp. 2215-2220.

*Primary Examiner*—John P. Sheehan

*Attorney, Agent, or Firm*—Parkhurst & Oliff

[57] ABSTRACT

Amorphous alloys having high strength, high hardness, high crystallization temperature, high saturation magnetic induction, low coercive force, high magnetic permeability and particularly low deterioration of magnetic properties with lapse of time, have a composition formula of $$T_aX_bZ_c \text{ or } T_{a'}X_{b'}Z_{c'}M_d,$$

wherein

T is at least one of Fe, Co and Ni,
X is at least one of Zr, Ti, Hf and Y,
Z is at least one of B, C, Si, Al, Ge, Bi, S and P,
a is 70–98 atomic %,
b is not more than 30 atomic %,
c is not more than 15 atomic %,
sum of a, b and c is 100 atomic %,
M is at least one Mo, Cr, W, V, Nb, Ta, Cu, Mn, Zn, Sb, Sn, Be, Mg, Pd, Pt, Ru, Os, Rh, Ir, Ce, La, Pr, Nd, Sm, Eu, Gd, Tb and Dy,
a' is 70–98 atomic %,
b' is not more than 30 atomic %,
c' is not more than 15 atomic %,
d is not more than 20 atomic %, and
sum of a', b', c' and d is 100 atomic %.

2 Claims, 6 Drawing Figures

AMORPHOUS ALLOYS

This is a continuation of application Ser. No. 269,004 filed May 15, 1981 now abandoned.

TECHNICAL FIELD

The present invention relates to amorphous alloys and more particularly to amorphous alloys having high strength, high hardness, high crystallization temperature, high saturation magnetic induction, low coercive force and high magnetic permeability, in which the deterioration of the above described properties with lapse of time is low.

BACKGROUND ART

Already well known amorphous magnetic materials are mainly alloys of a magnetic metal atom and a metalloid atom (for example, B, C, Si, Al, Ge, Bi, S, P, etc.), for example, $Fe_{80}B_{20}$, $(Co_{0.94}Fe_{0.06})_{79}Si_{10}B_{11}$ or $Fe_{80}P_{13}C_7$.

In these alloy systems, the sizes of the metal atoms and the metalloid atoms are greatly different and therefore it has been considered that these alloys can be made easily amorphous. However, these conventional amorphous alloys contain a large amount of metalloid atoms which relatively readily move at low temperatures, as the composing atoms, so that these amorphous alloys have the drawbacks that the properties possessed by these alloys, particularly the magnetic property, are noticeably varied with lapse of time. For example, in the case of amorphous alloy of $(Co_{0.94}Fe_{0.06})_{79}Si_{10}B_{11}$ consisting mainly of Co, which has high magnetic permeability, the effective magnetic permeability $\mu e$ immediately after heat treatment at 20 KHz is 16,000, but the permeability after keeping at 150° C. for 100 hours is deteriorated about 50% and $\mu e$ becomes 8,000. This deterioration is presumably caused by transfer of the metalloid atoms of B, Si, etc. Accordingly, the amorphous alloy having such a high deterioration with lapse of time cannot be practically used as the core for a magnetic head.

Therefore, the inventors have provided an invention by which the drawbacks of the above described conventional alloys have been obviated and filed the invention as Japanese Patent Application No. 121,655/79. The alloys of the above described invention are metal-metal system amorphous alloys wherein the conventional metalloid atoms are substituted with Zr, Hf, Ti and Y, and are characterized in that the conventional metalloid atoms are not substantially contained, so that the thermal stability is high and the deterioration with lapse of time is very low.

DISCLOSURE OF INVENTION

An object of the present invention is to provide amorphous alloys wherein the above described drawbacks possessed by the already known amorphous alloys, particularly the defect that the magnetic properties are deteriorated with lapse of time, are obviated and improved. The above described object can be attained by providing amorphous alloys having the basic composition shown by the following formula, which have excellent properties, such as high strength, high hardness, high crystallization temperature, high saturation magnetic induction, low coercive force and high magnetic permeability and in which the deterioration of the above described properties with lapse of time is low.

$T_aX_bZ_c$ or $T_{a'}X_{b'}Z_{c'}M_{d'}$ wherein p1 T is at least one of Fe, Co and Ni,
X is at least one of Zr, Ti, Hf and Y,
Z is at least one of B, C, Si, Al, Ge, Bi, S and P,
a is 70–98 atomic%,
b is not more than 30 atomic%,
c is not more than 15 atomic%, and
sum of a, b and c is 100 atomic%,
M is at least one of Mo, Cr, W, V, Nb, Ta, Cu, Mn, Zn, Sb, Sn, Be, Mg, Pd, Pt, Ru, Os, Rh, Ir, Ce, La, Pr, Nd, Sm, Eu, Gd, Tb, and Dy,
a' is 70–98 atomic%,
b' is not more than 30 atomic%,
c' is not more than 15 atomic%,
d is not more than 20 atomic%, and
sum of a', b', c' and d is 100 atomic%.

The characteristic of the stable amorphous alloys of the present invention is that the component T is 70–98 atomic%, the component X is not more than 30 atomic% and the component Z is not more than 15 atomic% and the alloys having the component composition within this range are commercially usable. (Atomic% is merely abbreviated as "%" hereinafter). But when the total amount of X and Z is less than 2%, it is difficult to obtain the amorphous alloys and such an amount is not practical.

When the amorphous alloys of the present invention are used as the magnetic material, the content of T as the magnetic atom is preferred to be 80–95% in view of the magnetic induction. When the total amount of the contents of Co and Fe is more than 50%, the amorphous alloys having excellent properties as the soft magnetic material can be obtained.

When the content of metalloid is larger, metalloid transfers and the obtained amorphous material embrittles, so that in the present invention, the content of Z is not more than 15%, but when the content of metalloid is less than 10%, metal-metal system of amorphous alloys in which the deterioration of the properties owing to the metalloid is very low and the crystallization temperature is high, that is the thermal stability is high, are obtained, so that such an amount is more preferable.

When the component M is more than 20% in the amorphous alloys of the present invention, the magnetization suddenly lowers, so that the component M must be not more than 20%.

BEST MODE OF CARRYING OUT THE INVENTION

The saturation magnetic induction in the alloys of the present invention is more than 12,000 G, when the ratio of $$\frac{Co + Fe}{Co + Fe + Ni}$$

is more than 0.5 and such alloys are particularly useful as the materials having high magnetic induction. Furthermore, in the alloys of the present invention, the coercive force Hc is as low as less than 0.2 Oe when the optimum heat treatment is applied and such alloys are particularly useful as the soft magnetic material.

Figure 1:
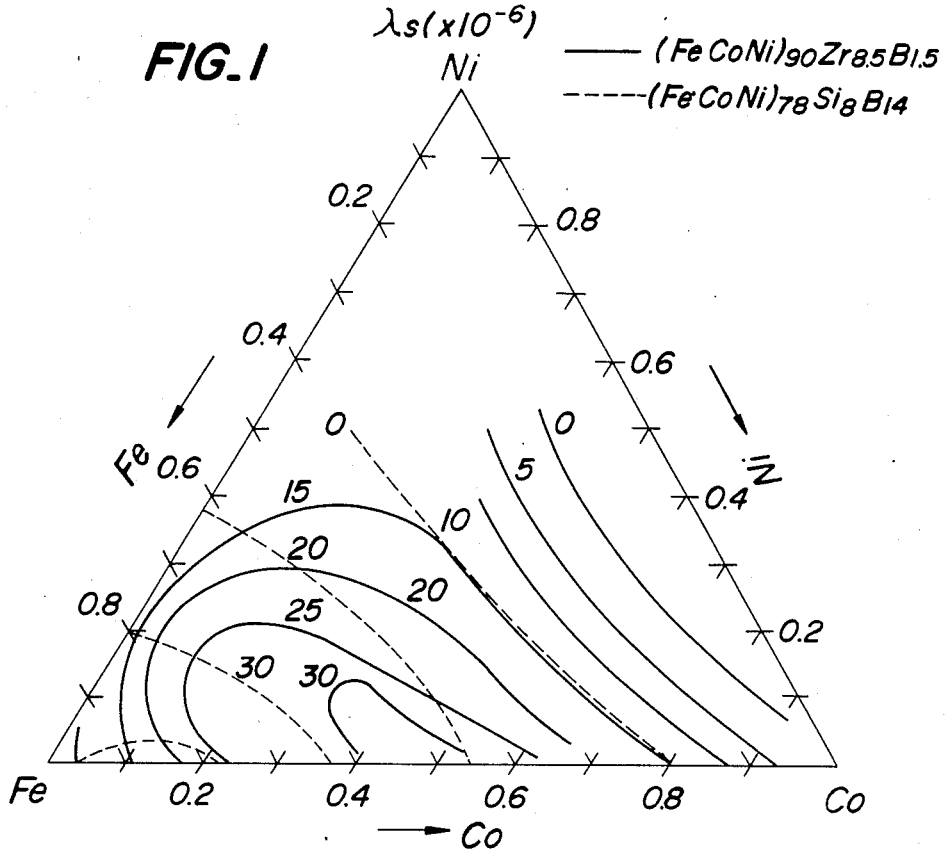
FIG. 1 is a view showing the relation of the content of Co and Ni to the magnetostriction in the alloys of the present invention.

As the content of Ni increases, the magnetic induction lowers but contrary to $(Fe_{1-x-y}Co_xNi_y)_{78}Si_8B_{14}$ system, as shown in FIG. 1 the line wherein the magnetostriction is 0, starts from the position of y=0.06–0.09 and x=0.91–0.94, for example, in $(Fe_{1-x-y}Co_xNi_y)_{90}Zr_{8.5}Bi_{1.5}$ system, so that when the alloy is used as a magnetic head material, it is preferred that Ni is contained and the magnetostriction is 0.

A material in which the magnetostriction is somewhat large but the coercive force (Hc) is small and the saturation magnetic induction Bs is large can be advantageously used as a transformer material and as the material having such properties, amorphous alloys composed of $(Fe_{0.95-0.4}Co_{0.05-0.6})_a,X_b,Z_c,M_d$, wherein a'=70–95, b'+c'+d=5–30, d=1–10, are advantageous. If the magnetostriction is adjusted to be 0 by substituting a part of Fe or Co of the amorphous alloys of this component composition with Ni, the magnetic permeability becomes higher, so that these alloys may be advantageously used, if necessary.

When the materials composed of the amorphous alloys according to the present invention and having high strengths are desired, materials wherein at least one of Fe, Co and Ni is the main component and a total content of the components X, Z and M is 20–30%, may be used and the materials are high in the strength and toughness and excellent in the workability.

In the amorphous alloys of the present invention, ones wherein at least one of Zr and Ti is the component X, can be produced in air, and further in argon atmosphere, amorphous alloys can be produced in iron series roll having a lower thermal conductivity than copper. These alloys have high formability.

In the amorphous alloys of the present invention, the alloys containing group IV elements, such as Cr, Mo, W. etc. in the component M are high in the hardness and crystallization temperature and are thermally stable.

Figure 2:
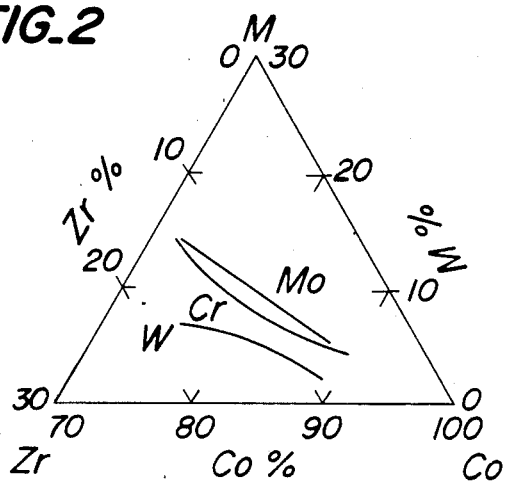
FIG. 2 is a view showing the relation of the content of Mo, Cr and W to the magnetostriction of the alloys of the present invention.

As seen from examples of $Co_a$, $Zr_b$, $B_1M_d$ shown in FIG. 2, it is possible to make the magnetostriction zero without containing Ni, and amorphous alloys having high magnetic induction and low magnetostriction can be obtained.

Alloys containing at least one of Pd, Pt, Ru, Os, Rh and Ir raise the crystallization temperature and improve the thermal stability and corrosion resistance.

The alloys containing at least one of Ce, La, Pr, Nd, Sm, Eu, Gd, Tb and Dy are very high in the crystallization temperature and greatly improve the thermal stability and are easily crystallized.

By making the content of the component M of the amorphous alloys of the present invention to be not more than 20%, the amorphous alloys having the above described preferable properties can be obtained. In order to improve the magnetic properties, it is desirable that the component M is less than 15%, more preferably less than 10%.

An explanation will be made with respect to a method for producing the amorphous alloys of the present invention.

In general, amorphous alloys can be obtained by quenching a molten metal and various cooling processes have been known for this purpose. For example, a molten metal is continuously ejected onto an outer circumferential surface of a roll rotating at high speed or between two rolls rotating oppositely with each other at high speed to quench and solidify the molten metal at a rate of about $10^{5°}$–$10^{6°}$ C./sec. on surface of the rotating roll or both the rolls.

The amorphous alloys of the present invention can be obtained similarly by quenching the molten metal and wire or plate form of amorphous alloys of the present invention can be produced by the above described various processes. Moreover, powdery amorphous alloys having a grain size from several μm to several tens μm can be produced through an atomizer in which a molten metal is sprayed onto opposing cooling copper plate by a high pressure of gas (nitrogen, argon gas, etc.) to quench and solidify the molten metal in fine powder state.

Then, the present invention will be explained with respect to examples hereinafter.

EXAMPLE 1

Amorphous ribbons having the composition shown in the following Table 1 were prepared in a roll quenching process in argon atmosphere by means of a quartz nozzle and the magnetic properties of the ribbons were measured. Then, after the ribbons were kept at 100° C. for 100 hours, the magnetic properties were again measured and the deteriorated ratio (deteriorated ratio of the effective magnetic permeability at 20 KHz) was determined and the results are shown in Table 1.

TABLE 1

| Composition | Bs (kg) | Hc (Oe) | Deteriorated ratio (%) |
|---|---|---|---|
| $Co_{89.5}Zr_{8.5}B_2$ | 13 | 0.03 | 2 |
| $(Fe_{0.9}Co_{0.1})_{90}Zr_{9.5}Co_{0.5}$ | 10.5 | 0.03 | 0.5 |
| $(Fe_{0.5}Co_{0.5})_{75}Zr_{20}Si_5$ | 15.5 | 0.06 | 3 |
| $(Fe_{0.15}Co_{0.55}Ni_{0.3})_{90}Zr_9Al_1$ | 10.5 | 0.1 | 5 |
| $Co_{8.5}(Zr_{0.8}Ti_{0.2})_{10}Ge_5$ | 11 | 0.1 | 2 |
| $(Co_{0.9}Ni_{0.1})_{85}(Zr_{0.7}Hf_{0.3})_{10}B_5$ | 11 | 0.07 | 4 |
| $(Fe_{0.85}Ni_{0.15})_{90}(Zr_{0.5}Y_{0.5})_7S_3$ | 10.5 | 0.06 | 2 |
| $(Fe_{0.7}Co_{0.2}Ni_{0.1})_{80}Ti_9(B_{0.5}C_{0.5})_{11}$ | 15 | 0.1 | 5 |
| $(Fe_{0.5}Co_{0.5})_{80}Hf_{10}(Si_{0.8}B_{0.2})_{10}$ | 11 | 0.07 | 0.5 |
| $(Fe_{0.6}Co_{0.4})_{90}Y_{6.5}(Al_{0.6}C_{0.4})_{3.5}$ | 15 | 0.05 | 1 |
| $(Fe_{0.7}Ni_{0.3})_{90}(Ti_{0.25}Hf_{0.75})_8(Si_{0.7}P_{0.3})_2$ | 12 | 0.035 | 3 |
| $Co_{93}Zr_6P_1$ | 13.5 | 0.05 | 1.5 |

As seen from the results in the above table, the ratio of Co+Fe/Fe+Co+Ni of the alloys of the present invention is more than 0.5% and Bs is higher and Hc is much lower than those of conventional amorphous materials and the stability is considerably excellent.

Figure 3:
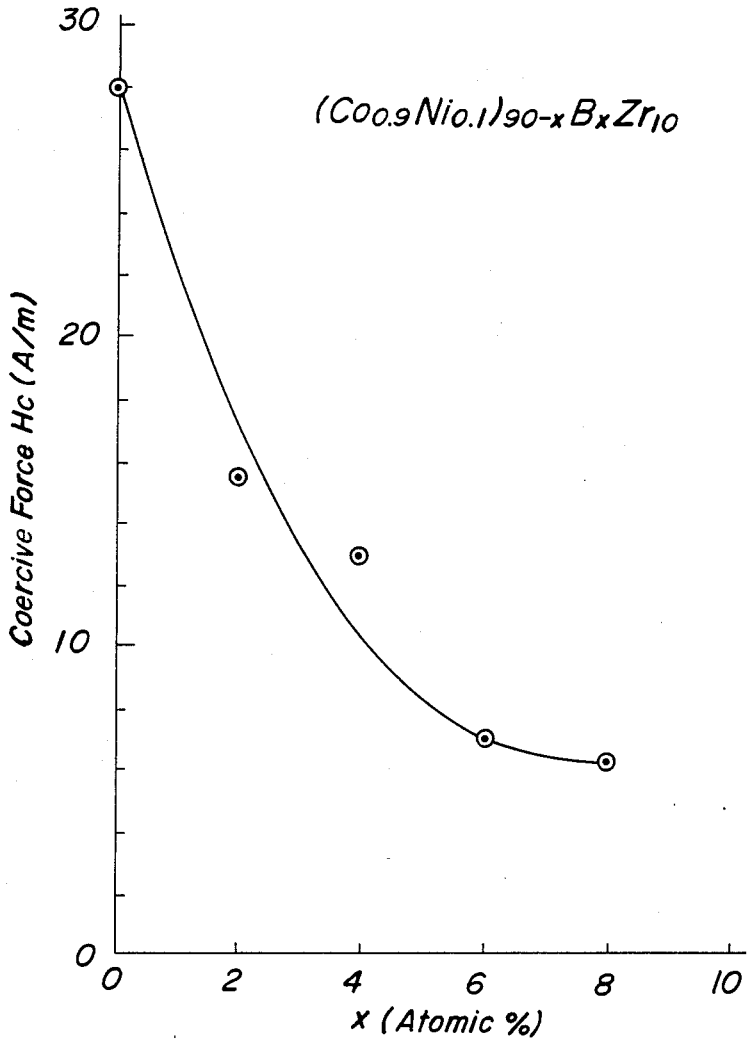
FIG. 3 is a view showing the relation of the content of metalloid elements to the coercive force in the alloys of the present invention.

In the amorphous alloys composed of $(Co_{0.9}Ni_{0.1})_{90-x}B_xZr_{10}$ according to the present invention, the variation of the coercive force of the quenched samples as such when the content of B which is one of the metalloid elements, is gradually increased, was examined and the obtained results are shown in FIG. 3. As seen from the results of FIG. 3, the coercive force can be reduced by addition of the metalloid element.

EXAMPLE 2

Molten metals at 1,200°-1,400° C. were ejected onto a stainless steel roll surface having a diameter of 300 mmϕ and rotating at 2,500 rpm to obtain ribbon-shaped amorphous alloys having various compositions shown in Table 2. The crystallization temperature Tx was measured by experiment and the obtained results are shown in Table 2.

TABLE 2(a)

| Composition | Crystallization temperature (Tx) (°C.) | Curie Point (Tc) (°C.) | Hardness (Hv) |
|---|---|---|---|
| $Co_{89}Zr_9B_{0.5}Mo_{1.5}$ | 480 | higher than 600 | 700 |
| $(Fe_{0.9}Co_{0.1})_{85}Zr_{9.5}B_{0.5}Cr_5$ | 550 | 800 | 750 |
| $(Fe_{0.7}Co_{0.3})_{80}Ti_{11}(B_{0.7}C_{0.3})_{8.5}W_{0.5}$ | 510 | 500 | 680 |
| $(Fe_{0.9}Co_{0.1})_{75}Ti_9(B_{0.7}Si_{0.3})_7Mn_9$ | 570 | 300 | 700 |
| $(Fe_{0.8}Co_{0.2})_{90}Hf_5(B_{0.75}Al_{0.25})_4V_1$ | 530 | 650 | 650 |
| $(Fe_{0.7}Co_{0.2}Ni_{0.1})_{90}Hf_7C_2(Mo_{0.5}V_{0.5})_2$ | 480 | higher than 600 | 700 |
| $(Fe_{0.6}Co_{0.4})_{90}Zr_7C_2(Mo_{0.75}Ta_{0.25})_2$ | 520 | higher than 650 | 720 |
| $(Fe_{0.5}Co_{0.5})_{84}Zr_{10}(C_{0.6}Si_{0.4})_5(Mo_{0.5}Cu_{0.5})_1$ | 530 | higher than 650 | 730 |
| $(Fe_{0.8}Co_{0.2})_{85}Y_{11}C_1(Cr_{0.9}Pd_{0.1})_3$ | 550 | 450 | 650 |
| $(Fe_{0.6}Co_{0.3}Ni_{0.1})_{85}Y_9Si_4(Cr_{0.6}Sb_{0.4})_2$ | 470 | higher than 600 | 720 |

TABLE 2(b)

| Composition | Crystallization temperature (Tx) (°C.) | Curie point (Tc) (°C.) | Hardness (Hv) |
|---|---|---|---|
| $(Fe_{0.6}Co_{0.4})_{85}(Zr_{0.7}Ti_{0.3})_{10}Si_3(Cr_{0.25}Sm_{0.75})_2$ | 560 | higher than 600 | 750 |
| $(Fe_{0.5}Co_{0.5})_{85}(Zr_{0.8}Ti_{0.2})_9Ge_1(W_{0.9}Ru_{0.1})_5$ | 550 | higher than 600 | 800 |
| $(Fe_{0.9}Co_{0.1})_{80}(Hf_{0.7}Y_{0.3})_8Bi_{9.5}(W_{0.8}Os_{0.2})_{2.5}$ | 530 | 300 | 750 |
| $(Fe_{0.9}Co_{0.1})_{90}(Hf_{0.8}Y_{0.2})_7S_1W_2$ | 500 | 310 | 700 |
| $(Fe_{0.8}Co_{0.2})_{90}Zr_{8.5}B_{0.5}Sm_1$ | 550 | 400 | 810 |
| $(Fe_{0.3}Co_{0.7})_{87}(Zr_{0.5}Hf_{0.5})_{10}B_{2.5}Eu_{0.5}$ | 530 | higher than 650 | 750 |
| $(Fe_{0.3}Co_{0.5}Ni_{0.2})_{90}Zr_7B_1Gd_2$ | 470 | higher than 600 | 800 |
| $(Fe_{0.8}Co_{0.2})_{85}(Zr_{0.8}Ti_{0.1}Hf_{0.1})_{10}C_{4.5}Tb_{0.5}$ | 550 | 350 | 830 |
| $(Fe_{0.7}Co_{0.2}Ni_{0.1})_{90}(Ti_{0.8}Y_{0.2})_6C_2Dy_2$ | 500 | higher than 600 | 700 |
| $(Fe_{0.7}Co_{0.2}Ni_{0.1})_{90}Zr_8C_{1.5}Nd_{0.5}$ | 480 | higher than 600 | 810 |

As seen from Table 2, the amorphous alloys of the present invention have a crystallization temperature (Tx) of higher than 450° C. and a major part of the alloys have curie point (Tc) of higher than 650° C. and this is presumably the cause that the magnetic properties are relatively more thermally stable than the conventional alloys.

Figure 4:
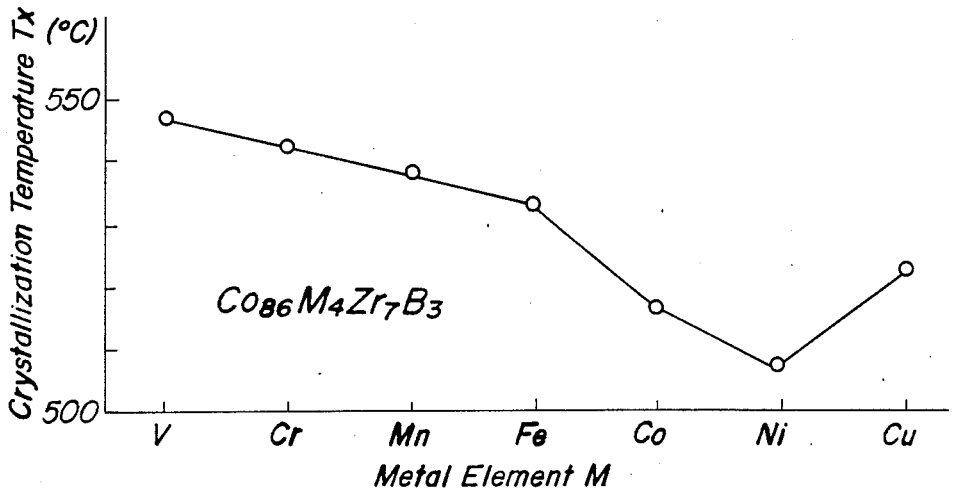
FIGS. 4 and 5 are views showing an embodiment of the effect for improving the crystallization temperature when metal elements are added in the alloys of the present invention respectively.
Figure 5:
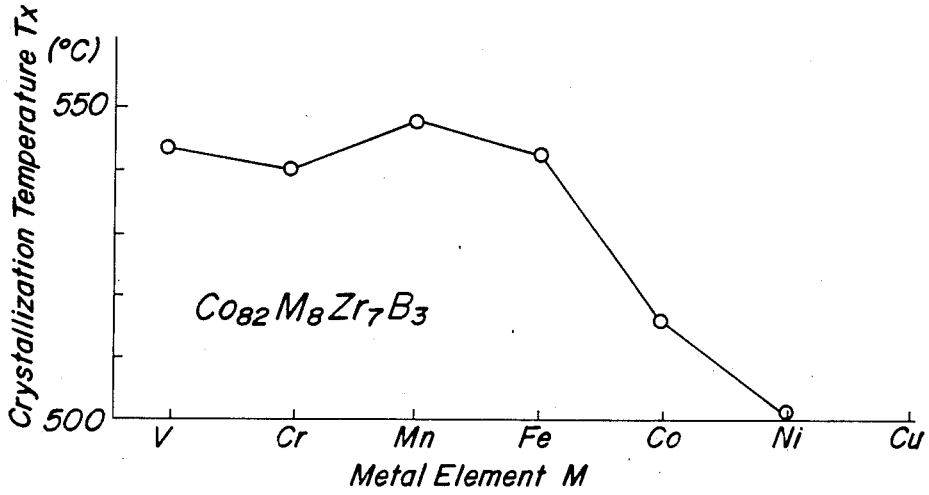

It is apparent that the amorphous alloys having high hardness can be obtained by containing rare earth elements, such as Sm, Eu, etc. The crystallization temperatures when a part of Co in the composition of $Co_{89.5}Zr_{8.5}B_2$ was substituted with 4% and 8% of V, Cr or Mn are shown in FIGS. 4 and 5 respectively. In both FIGS. 4 and 5, M shows the substituted metal elements V, Cr, Mn, etc. From both FIGS. 4 and 5, it is apparent that the crystallization temperature is raised by addition of the metal element M.

EXAMPLE 3

Figure 6:
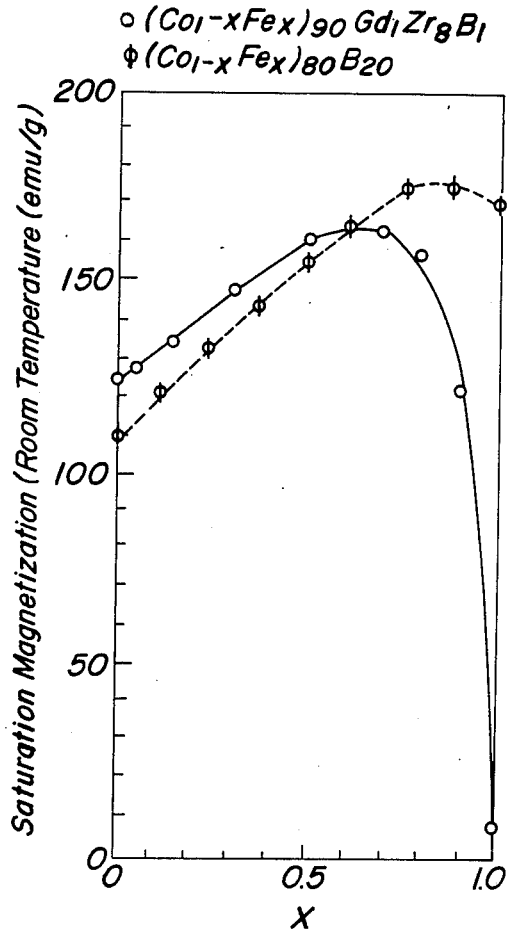
FIG. 6 is a view showing the relation of the content of Co to the saturation magnetization in the alloy of the present invention.

Alloys having the composition of $(Co_{1-x}Fe_x)_{90}Gd_1Zr_8B_1$ were prepared and the dependency of the saturation magnetization to x was examined and as the result, the dependency of the saturation magnetization to x of these alloys is different from that of the alloys having the composition of $(Co_{1-x}Fe_x)_{80}B_{20}$ as shown in FIG. 6, even if x becomes smaller, the lowering of $\sigma$ value is smaller, so that in $(Co_{1-x}Fe_x)_{90}Gd_1Zr_8B_1$ system, the alloys in which $\sigma$ is larger than that of $(Co_{1-x}Fe_x)_{80}B_{20}$ system alloys, are obtained in Co rich side.

By containing rare earth elements, such as Gd, etc. or Y, the amorphous alloys in which the crystallization temperature is increased, the magnetic properties are stabilized and are scarcely varied with lapse of time, can be obtained.

EXAMPLE 4

Amorphous alloys having the composition shown in Table 3 were produced in the same manner as described in Example 2 and the crystallization temperature Tx and the critical breakage temperature Tf and the stability Tf/Tx of the alloys were determined. The obtained results are shown in Table 3. The critical breakage temperature Tf means the temperature at which the sample is broken in 180° bending. Bending strain $\epsilon f$ is shown by the following equation $$\epsilon f = t/(2r-t)$$

r: Curveture radius of bending, t: Thickness of sample.

When the breakage occurs in the 180° bending in r=t, $\epsilon f$ becomes 1.

TABLE 3

| Composition | Crystallization temperature (Tx) (°C.) | Critical breakage temperature (Tf) | Stability Tf/Tx |
|---|---|---|---|
| $Co_{89}Zr_9B_2$ | 470 | 380 | 0.81 |
| $Co_{89}Ti_9B_2$ | 460 | 320 | 0.70 |
| $Co_{89}Hf_9B_2$ | 470 | 340 | 0.72 |
| $Co_{89}Y_9B_2$ | 470 | 340 | 0.72 |
| $Co_{89}Zr_9B_{0.5}Mo_{1.5}$ | 480 | 400 | 0.83 |
| $Co_{89}Ti_9B_{0.5}Mo_{1.5}$ | 470 | 340 | 0.72 |
| $Co_{89}Hf_9B_{0.5}Mo_{1.5}$ | 480 | 350 | 0.73 |
| $Co_{89}Y_9B_{0.5}Mo_{1.5}$ | 480 | 350 | 0.73 |

EXAMPLE 5

Amorphous alloys having various compositions shown in the following Table 4 were prepared in the same manner as described in Example 4 and the saturation magnetic induction thereof was measured.

TABLE 4

| Composition | Saturation magnetic induction (kg) |
|---|---|
| $Co_{83}Zr_{10.5}B_{0.5}Mo_6$ | 7.7 |
| $(Co_{0.5}Fe_{0.5})_{80}Zr_{10.5}B_{0.5}W_6$ | 8.9 |
| $(Co_{0.8}Fe_{0.2})_{80}Zr_{10.5}B_{6.5}Mo_3$ | 10.0 |
| $(Co_{0.2}Fe_{0.2}Ni_{0.6})_{80}Zr_5Ti_5B_7Mo_3$ | 8.0 |
| $(Co_{0.9}Ni_{0.1})_{87.5}Hf_6Y_2B_{1.5}C_{1.5}Cr_{1.5}$ | 10.7 |
| $Co_{87.5}Ti_{4.5}Hf_{2.5}P_3Si_{0.5}Mo_1W_1$ | 13.1 |
| $(Fe_{0.3}Ni_{0.7})_{83}Zr_{10.5}Y_{1.5}Ge_{3.5}Mo_{1.5}$ | 6.9 |
| $(Co_{0.4}Fe_{0.4}Ni_{0.2})_{84}Zr_8Ti_4B_2Mo_2$ | 12.7 |
| $(Fe_{0.7}Co_{0.2}Ni_{0.1})_{80}Hf_{15}Si_{3.5}Cr_{1.5}$ | 9.1 |

As seen from Table 4, in $$\frac{Fe + Co}{Fe + Co + Ni}$$

of more than 0.5, the excellent saturation magnetic induction can be obtained. When an amount of Cr, Mo or W added is less than 5%, particularly excellent properties can be obtained.

Thus, the amorphous alloys of the present invention are not only excellent in the stability but also more to easily produced than conventional amorphous alloys and are excellent in the corrosion resistance and abrasion resistance and high in the strength and relatively high in the crystallization temperature and curie point and high in the magnetic induction and the magnetostriction can be freely adjusted.

INDUSTRIAL APPLICABILITY

The amorphous alloys of the present invention are noticeably excellent materials for magnetic head for audio, VTR and computer, and for magnetic converters, and are alloys having high commercial value which can be utilized as structural materials.

We claim:

1. Amorphous metal alloys having a composition shown by the following formula $$T_a\overline{X}_bZ_c$$

wherein $T_a$ shows a atomic % of at least one of Fe, Co and Ni, $\overline{X}_b$ shows b atomic % of Hf or a combination of Hf and at least one of Zr Ti, and Y, $Z_c$ shows c atomic % of at least one of B, C, Si, Al, Ge, Bi, S and P, and characterized by the formulas, $$70 \leqq a \leqq 98,\ 5 \leqq b \leqq 30,\ 0 < c \leqq 0.5.$$

2. Amorphous metal alloys having a composition shown by the following formula $$T_a\overline{X}_bZ_cM_d$$

wherein $T_a$ shows a atomic % of at least one of Fe, Co and Ni, $\overline{X}_b$ shows b atomic % of at least Hf or a combination of Hf and at least one of Zr Ti, and Y, $Z_c$ shows c atomic % of at least one of B, C, Si, Al, Ge, Bi, S and P, $M_d$ shows d atomic % of at least one of Mo, Cr, W, V, Nb, Ta, Cu, Mn, Zn, Sb, Sn, Be, Mg, Pd, Pt, Ru, Os, Rh, Ir, Ce, La, Pr, Nd, Sm, Eu, Gd, Tb and Dy, and characterized by the formulas, $$70 \leqq a \leqq 98,\ 5 \leqq b \leqq 30,\ 0 < c \leqq 0.5,\ 0 < d \leqq 20.$$

* * * * *